US005323709A

United States Patent [19]

Dickey et al.

[11] Patent Number: 5,323,709

[45] Date of Patent: Jun. 28, 1994

[54] DEMOLDER

[75] Inventors: Thomas E. Dickey, Manchester, Mo.; Thomas Y. Gehr, Jr., Northbrook, Ill.

[73] Assignee: ESCO Equipment Service Company, Palatine, Ill.

[21] Appl. No.: 29,888

[22] Filed: Mar. 11, 1993

[51] Int. Cl.[5] ..... E01B 11/00

[52] U.S. Cl. ..... 104/2; 104/15

[58] Field of Search ..... 29/267, 239, 426.2; 104/15, 2; 164/404, 344

[56] References Cited

U.S. PATENT DOCUMENTS 1,168,061 1/1916 Deppeler ..... 104/15

4,359,083 11/1982 Jacobsen ..... 164/404

FOREIGN PATENT DOCUMENTS 0083288 7/1971 Fed. Rep. of Germany ..... 104/15

*Primary Examiner*—Mark T. Le

*Attorney, Agent, or Firm*—Lloyd L. Zickert

[57] ABSTRACT

A demolder for and a method of separating and removing mold material formed around two rail ends of longitudinally adjacent railroad rails during the use of a thermite weld system to join the rails into a continuous rail. The demolder includes an open-ended steel box sized to be positioned about the mold material having substantially aligned slots provided on opposite sides of the box to freely receive the rail and a handle extending upwardly from the box for moving and handling the box.

12 Claims, 3 Drawing Sheets

DEMOLDER

This invention relates in general to a demolder, and more particularly to a demolder for and a method of separating and removing mold material formed around the joint of the rail ends of longitudinally adjacent railroad rails during the use of a thermite weld system to join the rails into a continuous rail.

BACKGROUND OF THE INVENTION

Heretofore, it has been well known in the railroad industry to eliminate rail joints by using a thermite weld system or weld to weld together two rail ends to form a smooth, continuous, and uninterrupted railroad rail. The thermite weld system is generally made by mounting a mold structure around the joint area of the two rail ends with an entry or gate on top for receiving molten weld material. The use of the thermite weld system is quite old and widespread in the railroad industry, and the system is time-consuming, labor-intensive, and hazardous to workers.

More specifically, to join two rail ends using the thermite weld system, the rails are laid and carefully aligned, leaving a small space between the ends. After alignment and leveling of the rail ends, the thermite weld system, which may include a three-piece mold preformed from a suitable refractory, such as bentonite and sand, is attached to the rail ends. One mold piece underlies both rail ends and two pieces extend upwardly from the lower piece on opposite sides of the rail ends. These mold pieces are securely clamped together and to the rails and extend over the top of the rails, leaving a gate at the top for the molten metal weld material to enter the mold. The mold may be arranged with upwardly extending risers coming off the shoe of the rails to allow trapped air and gases to escape when the molten metal weld material flows into the mold. A suitable material may be used to eliminate any spaces or gaps between the mold pieces and the rail surfaces.

As part of the welding process, the rail ends and surrounding portions of the rails are preheated by use of a propane torch or other suitable means to a red-hot condition of approximately 1800° F. prior to pouring the molten weld material into the mold.

A crucible filled with a suitable powdered metal mixture is placed over the mold. The powdered metal mixture is ignited to transform the mixture into molten metal at approximately 4000° to 5000° F. The molten metal is then poured through the gate into the mold to fill the space between the rail ends and make the weld joint between the rail sections.

After waiting approximately five minutes, the weld joint has cooled enough to remove the malleable mold material from around the joint. However, the mold material remains dangerously hot. The crucible is removed, and then the clamps holding the mold material are carefully removed, leaving the hot mold material on the rails.

Heretofore, removing this mold material required two people. The first person would hold a shovel on the rail at one side of the mold, while the second person would slowly break off parts of the mold material with a sledge hammer. As the material was broken by the person handling the sledge, the material was caught in the shovel by the person handling the shovel. The use of the sledge hammer is dangerous because it can cause sparks to shoot out from the mold material and may further cause pieces of hot mold material to fly off of the rails. The person with the shovel then would carry the mold material which was still dangerously hot to a location where the ground was dry. If the broken mold material was accidentally dropped or placed in water or even in a wet location, a dangerous reaction or explosion could occur, and which in the past has caused severe injury. This dangerous process would be repeated until sufficient amounts of the mold material on the top of the rail, as well as on both sides of the rail, were removed.

A hydraulic shear would then be placed on the top of the rails to shear off the sprue left during the molding process. A grinder would next be used to smooth the weld at the ball of the rail. Although it was not necessary to remove the lower part of the mold material, some railroads would do so for the purpose of making the rail look neater. Any mold material left on the rail would eventually disintegrate in the weather.

SUMMARY OF THE INVENTION

The present invention overcomes the above problems in providing a demolder for safely separating and removing the mold material from the rail ends by one person after the clamps are removed and for safely carrying the separated mold material away from the rails to a dry location. The demolder of the present invention is in the form of a box having an open lower end and a handle extending upwardly from the box. On opposite sides of the box, substantially aligned slots are provided to allow the box to fit over about two-thirds of the rail.

In practice, once the clamps are removed from the mold material, a single person or operator positions the demolder of the present invention over the mold material and the rail. The operator then rocks the demolder along the longitudinal axis of the rail to loosen and separate the mold. Once the mold material is separated from the rails, the demolder is longitudinally lowered to a position substantially parallel to the rails while maintaining the separated mold material therein. The demolder is then lifted away from the rail with the separated mold material in its box and is carried to a dry location where the box of the demolder is emptied of mold material.

It is therefore an object of the present invention to provide a demolder for safely separating and removing the mold material formed around the joint of two adjacent railroad rail ends during a thermite welding process.

Another object of the present invention is provide a method in which one person or operator can separate and remove a substantial portion of the mold material around the joint of the rail ends, thereby eliminating the need for two people to demold the joint.

A still further object of the present invention is to increase safety by better containment of the hot mold material as it is separated and carried away from the joint.

A still further object of the present invention is to decrease the time necessary to remove the mold material from the joint of two rails and thereby increase the efficiency of the thermite weld system.

Other objects, features and advantages of the invention will be apparent from the following detailed disclosure, taken in conjunction with the accompanying sheet of drawings, wherein like reference numerals refer to like parts.

DESCRIPTION OF THE INVENTION

Figure 1:
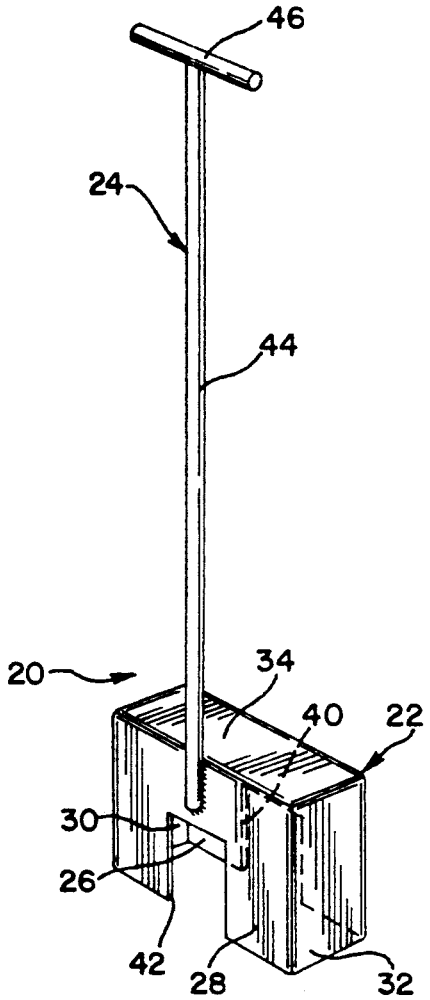
FIG. 1 is a perspective view of the demolder of the invention.
Figure 2:
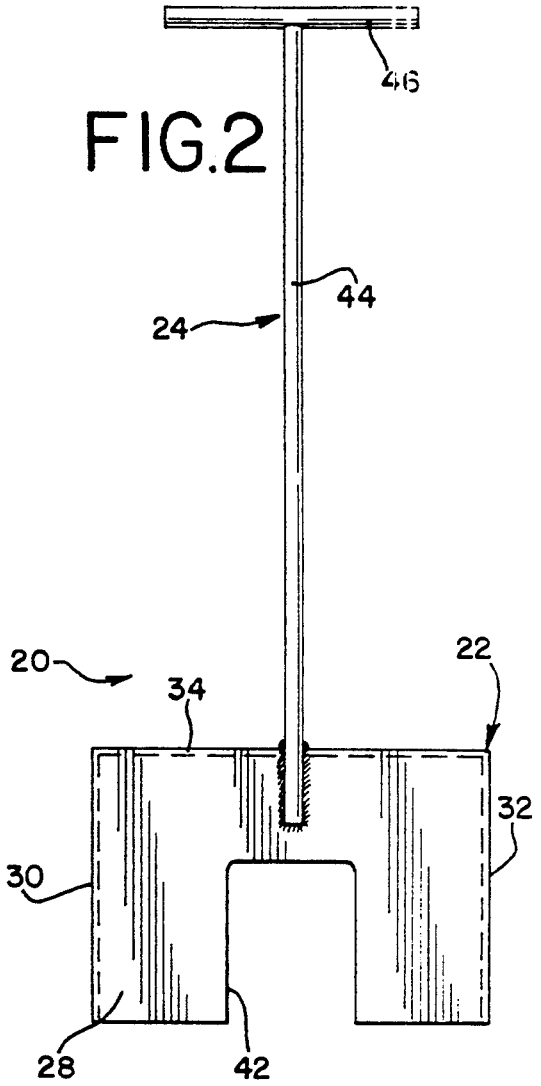
FIG. 2 is an elevational view of the back wall of the demolder.
Figure 3:
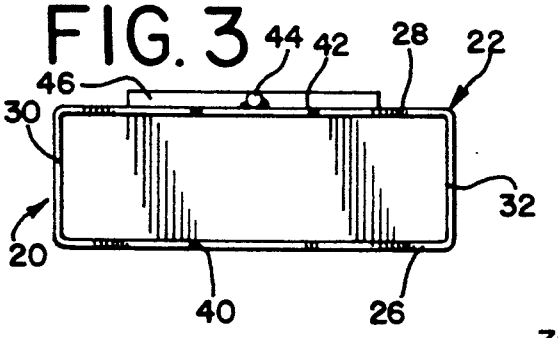
FIG. 3 is a bottom plan view of the demolder.
Figure 4:
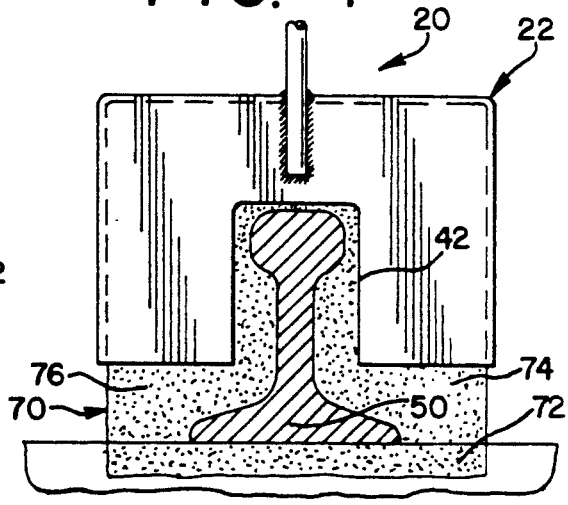
FIG. 4 is an elevational view of the demolder like FIG. 2 and illustrating the demolder in mounted position on a rail over a mold for a thermite weld system.

Referring now to the drawings, and particularly to FIGS. 1 to 3, the demolder 20 of the present invention includes an open- ended steel box or casing 22 and a handle 24 extending from the box 22. The box 22 consists of a front wall 26, a back wall 28, opposed side walls 30 and 32 and a top cover or wall 34. The spaced-apart front and back walls and the spaced-apart side walls define upper and lower ends respectively. The top cover 34 is connected to the front, back, and side walls and closes the upper end of the box 22. The lower end remains open. It is preferred that the front, back, and side walls as well as the top cover are welded together; however, it should be appreciated that the walls and cover could be connected by other means. They are closed so as to contain the mold material during a demolding operation.

Aligned slots or cutouts 40 and 42 are formed in the front and back walls. These slots extend from the lower opening toward the top cover 34 and are centrally located in the front and back walls. The height of the slots is approximately two-thirds the height of the railroad rail and slightly wider than the rail such that the rail may be freely received in the slots.

The handle 24 is T-shaped and includes an elongated bar 44 and a gripping crossbar 46. Preferably, the bars are tubular steel. The bar 44 is attached to and extends upwardly from the back wall 28 and the crossbar 46 is perpendicularly attached to the bar 44 to allow a person to grip on both sides of the bar 44. The handle is used to manipulate and carry the box 22. It should be appreciated that the handle could be attached to the front wall, side walls, or the top cover if desired, and the structure of the handle may take other forms. Preferably, the handle is attached to the back wall 28 of the box 22 and centered between the opposed edges of the back wall.

Figure 8:
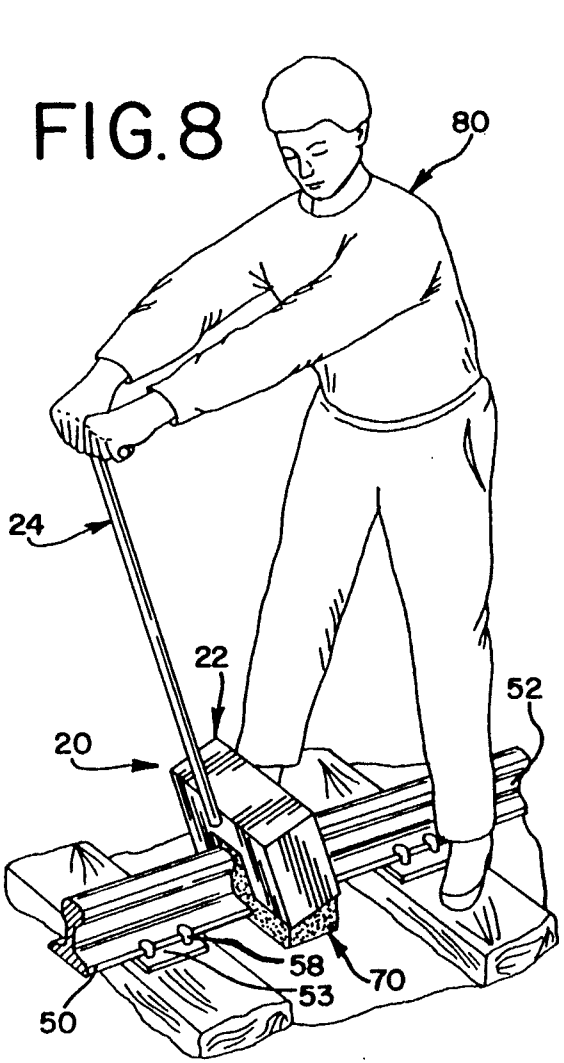
FIG. 8 is a perspective view of a person pushing or rocking the demolder away from his body as part of a rocking action.
Figure 7:
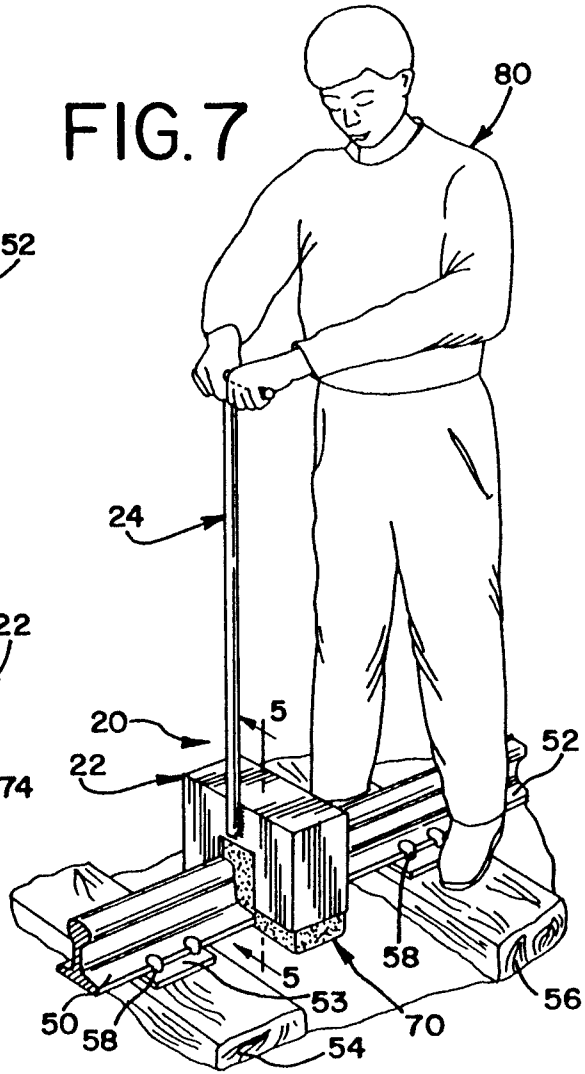
FIG. 7 is a perspective view of a person holding the demolder vertically on a mold with the front of the demolder facing the person.
Figure 5:
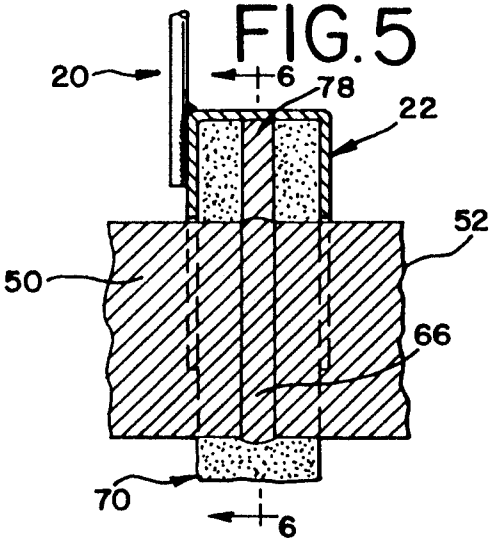
FIG. 5 is a transverse cross-sectional view of the demolder over the mold material on a rail joint for a thermite weld system illustrating the general construction of the mold and taken substantially through line 5—5 of FIG. 7.
Figure 6:
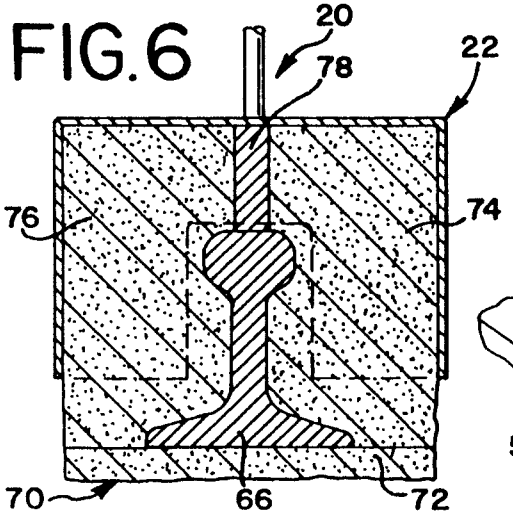
FIG. 6 is a longitudinal cross-sectional view through the demolder, mold material, and ball portion of the rail taken substantially through line 6—6 of FIG. 5.
Figure 10:
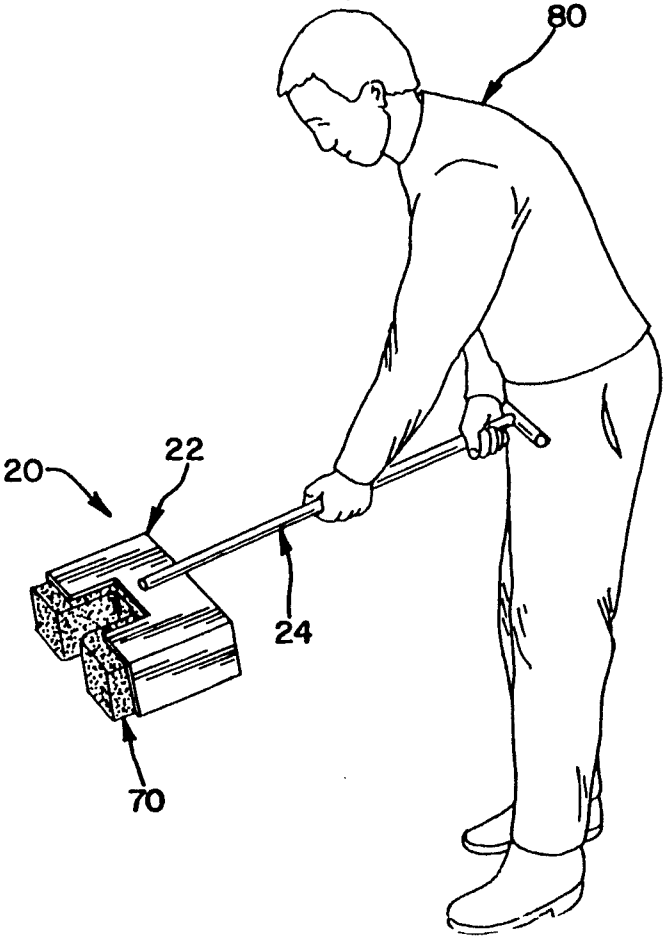
FIG. 10 is a perspective view of a person carrying the demolder, front wall down, horizontally with broken away mold material.
Figure 9:
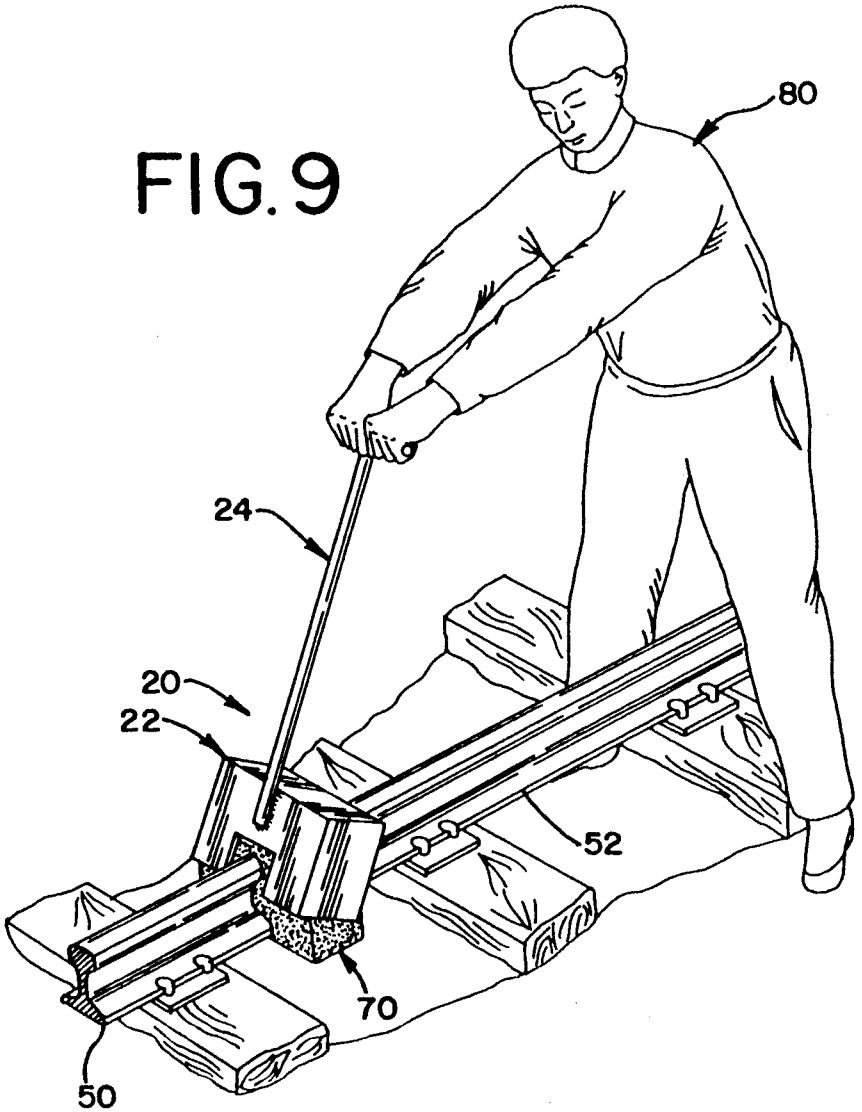
FIG. 9 is a perspective view of a person pulling the demolder toward his body as part of a rocking action.

A rough illustration of part of the thermite weld system is shown in FIGS. 4 to 7, it being understood the crucible and mold clamps have been removed. Two longitudinally adjacent railroad rails 50 and 52 which are mounted on the tie plates 53 and respectively secured to the railroad ties 54 and 56 by spikes 58. The adjacent rail ends form a gap that is shown filled by molten metal to form a thermite weld 66 which welds the ends of the rails together. Surrounding the joint is mold material 70 made of a suitable refractory, such as bentonite and sand, which is formed from a bottom mold piece 72 and two side mold pieces 74 and 76. The bottom mold piece 72 underlies both rail ends and the side mold pieces 74 and 76 extend upwardly from the bottom mold piece on opposite sides of the joint. The mold material 70 shown in FIGS. 4 to 7 as well as FIGS. 8 to 10 is for illustration purposes only, as the size, shape, and structure of the mold material can vary. For example, a two-piece mold may be used. The mold material may also be arranged with upwardly extending risers (not shown) coming off the rails to allow trapped air or gases to escape when the molten metal flows through the gate 78 and into the mold formed at the joint.

As seen in FIGS. 4 to 8, the demolder 20, and specifically the lower end of the box 22, is shown positioned over and encasing a substantial part of the malleable and hot mold material 70. The slots 40 and 42 of the box fit over the rails 50 and 52, respectively, and extend down over approximately two-thirds of the rails. Likewise, the front, back, and side walls of the demolder extend down over approximately two-thirds of the mold material of the mold.

Referring now to FIGS. 7 to 10, the method of separating and removing the mold material 70 from the joint of the rails 50 and 52 with a demolder 20 of the present invention is illustrated. A single person or operator 80 positions the demolder 22, and specifically the box 22, over the mold material after the clamps (not shown) for clamping the mold parts together and to the rails are removed. The operator initially grips the crossbar 46 of the handle 24 to rock the demolder towards him and away from him longitudinally along the rails until portions of the mold material 70 separate from the rails. This method essentially eliminates the danger from sparks shooting out from contact between the sledge hammer and the mold material. Also eliminated is the possibility of danger from flying pieces of hot mold material heretofore caused by using the sledge hammer to remove the mold.

Once the mold material 70 is separated from the rails by the rocking action of the demolder, the operator lowers the demolder toward the rail 52 to load the mold material into the casing 22. It should be appreciated that since the handle is placed on the back of the demolder, when the operator lowers the demolder toward him and to a substantially horizontal position, the handle 24 of the demolder will not contact the rail 52, thereby allowing the operator to easily pick up the demolder by grasping the bar 44. The operator then lifts the demolder with the separated mold material from the weld joint and carries the demolder with the separated mold material to a dry location, where the separated mold material is emptied from the casing. While the handle is positioned on the upper side of the box when carrying mold material, it may be appreciated that the handle could be on the bottom side if desired. It should be appreciated that if the mold material is placed in water or a wet location which triggers a reaction or explosion, the casing of the demolder can shield the operator from injury.

In addition to greatly enhancing the safety of the operator during the demolding process, the demolder and the method of using the demolder eliminate the need for two people to demold the mold material. One person or operator can handle the demolder to break off and scoop up a major portion of the mold material and carry it to a disposal area. Thus, the demolder efficiently and safely increases the speed of the entire welding process, enhances worker safety, and decreases labor costs.

It will be understood that modifications and variations may be effected without departing from the scope of the novel concepts of the present invention, but it is understood that this application is to be limited only by the scope of the appended claims.

The invention is hereby claimed as follows:

1. A demolder for separating and removing mold material formed around two rail ends of longitudinally adjacent railroad rails during the use of a weld system to join the rails into a continuous rail comprising, a casing sized to fit over the mold material, the casing having spaced-apart front and back walls connected by spaced-apart side walls defining upper and lower ends, a top cover connected to the front, back, and side walls substantially closing the upper end of the casing and said lower end of the casing being open, aligned slots formed in the front and back walls sized to freely receive the rail and extending from the lower end toward the top cover;

and a handle extending from the casing for manipulating the demolder.

2. The demolder as defined in claim 1, wherein the slots in the front and back walls are centrally located between the side walls.

3. The demolder as defined in claim 1, wherein, the handle is centrally connected to the front wall.

4. The demolder as defined in claim 1, wherein the handle is centrally connected to the back wall.

5. The demolder as defined in claim 1, wherein the height of the slots in the front and back walls are approximately two thirds the height of the rail.

6. The demolder as defined in claim 1, wherein the weld system is a thermite weld system.

7. A demolder for separating and removing mold material formed around two rail ends of longitudinally adjacent railroad rails during the use of a weld system to join the rails into a continuous rail comprising an open ended box-shaped casing sized to be closely positioned around the mold material, the casing having a pair of opposing spaced-apart walls, a slot wider than the rail in each of said walls, the slots in the walls being substantially aligned and a handle attached to the casing.

8. The demolder as defined in claim 7, wherein the weld system is a thermite weld system.

9. A demolder for separating and removing mold material formed around two rail ends of longitudinally adjacent railroad rails during the use of a thermite weld system to join the rails into a continuous rail comprising, a casing means for encasing the mold material and separating a substantial portion of the mold material from the rail and for retaining the separated portion of the mold material for removal from the rail;

and a handle means for moving and carrying the casing means.

10. A demolder as defined in claim 9, wherein said casing means includes an open ended box adapted to be positioned on the mold material, the box having a pair of opposing spaced-apart walls, a slot, wider than the rail, in each of said walls, the slots in the walls being substantially aligned.

11. A demolder as defined in claim 10, wherein said handle means includes a pole attached to the box.

12. A method of separating and removing mold material of a thermite welding system from two rail ends of longitudinally adjacent railroad rails with a demolder having an open ended box-shaped casing sized to be positioned over and around the mold material, the casing having a pair of opposing spaced-apart walls, each including a slot sized to freely receive the rail, the slots in the walls being substantially aligned and a handle attached to the casing, which comprises:

(a) positioning the casing of the demolder over the mold material;

(b) rocking the demolder forward and backward longitudinally along the rail until portions of the mold material separates from the rail;

(c) lowering the demolder toward the rail to load the mold material into the casing;

(d) lifting the demolder with the separated mold material from the rail;

(e) carrying the demolder to a dry location; and (f) emptying the mold material from the casing onto the dry location.

* * * * *